US006754456B2

(12) United States Patent
Ahn

(10) Patent No.: US 6,754,456 B2
(45) Date of Patent: Jun. 22, 2004

(54) DRIVE MECHANISIM FOR ELECTROPHOTGRAPHIC IMAGE FORMING APPARATUS

(75) Inventor: Byung-sun Ahn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/301,694

(22) Filed: Nov. 22, 2002

(65) Prior Publication Data

US 2003/0170048 A1 Sep. 11, 2003

(30) Foreign Application Priority Data

Mar. 11, 2002 (KR) ..... 2002-0012988

(51) Int. Cl.[7] ..... G03G 15/00
(52) U.S. Cl. ..... 399/75; 399/401
(58) Field of Search ..... 399/75, 88, 37, 399/107, 167, 401, 381, 36; 271/902

(56) References Cited

U.S. PATENT DOCUMENTS 5,633,699 A * 5/1997 Aruga et al. ..... 399/107
5,701,549 A * 12/1997 Portig et al. ..... 399/167 X
5,848,333 A * 12/1998 An ..... 399/167
5,937,262 A * 8/1999 Cho ..... 399/401
5,970,286 A * 10/1999 Numazu et al. ..... 399/167
5,974,283 A * 10/1999 Cho ..... 399/75

FOREIGN PATENT DOCUMENTS

JP 06-298399 * 10/1994

* cited by examiner

*Primary Examiner*—Sophia S. Chen
(74) *Attorney, Agent, or Firm*—Staas & Halsey LLP

(57) ABSTRACT

A drive mechanism of an image forming apparatus includes a first part including a conveyor to convey an image transfer body, an image forming apparatus to form an image on the image transfer body, a first motor to drive the conveyor and the image forming apparatus, and a first transmitter to transmit power generated in the first motor to the conveyor and the image forming apparatus. The drive mechanism also includes a second part including a fixing device to fix the formed image on the image transfer body, a delivery roller to discharge the image transfer body having the image fixed thereon, a conveying roller to convey the image transfer body for duplex printing, a second motor to drive the fixing device, and the rollers, and a second transmitter to transmit power generated in the second motor to the fixing device, and the rollers.

33 Claims, 3 Drawing Sheets

DRIVE MECHANISIM FOR ELECTROPHOTGRAPHIC IMAGE FORMING APPARATUS

CROSS-REFERENCE TO RELATED APPLICATIONS

This application claims the benefit of Korean Application No. 2002-12988, filed Mar. 11, 2002, in the Korean Intellectual Property Office, the disclosure of which is incorporated herein by reference.

BACKGROUND OF THE INVENTION

1. Field of the Invention

The present invention relates to an electrophotographic image forming apparatus having a duplex function, and more particularly, to a drive mechanism for an electrophotographic printer capable of operating an image forming apparatus using a low capacity motor and efficiently having a duplex function.

2. Description of the Related Art

An electrophotographic image forming apparatus is an apparatus, such as a printer or copier, that prints by forming an electrostatic latent image on a photosensitive body using a laser, developing this image using a developing agent, and transferring the image to an image transfer body. The present invention will be explained by referring to a laser printer, however, the present invention may be applied to any electrophotographic image forming apparatus.

Referring to FIG. 1, an electrophotographic image forming apparatus having a duplex printing function has a paper feeding unit, a developing unit, a fixing unit, a delivery unit and a duplex printing unit. This apparatus also includes a drive mechanism, which may be the known drive mechanism of FIG. 2, or the drive mechanism according to an embodiment of the present invention, as shown in FIGS. 3 and 4.

The paper feeding unit supplies an image transfer body (such as a sheet of paper) and includes a paper feeding cassette 1, a feeding unit transfer roller 5, and a registration roller 7. Also, the paper-feeding unit can include a manual paper feeding tray 13 that can supply various types of image transfer bodies.

The paper feeding cassette 1 stacks a large number of the image transfer bodies and has a pickup roller 3 at the front end thereof to supply the stacked image transfer bodies one by one. The feeding unit transfer roller 5 conveys the image transfer body supplied by the pickup roller 3 to the registration roller 7. The registration roller 7 aligns the front end of the image transfer body conveyed from the feeding unit transfer roller 5 and supplies the image transfer body to the developing unit. The manual paper feeding tray 13 supplies various types of image transfer bodies such as OHP film, an envelope or a labeling sheet, and conveys the image transfer body stacked on the manual paper feeding tray 13 to the registration roller 7, using a multipurpose pickup roller 11 installed at the front end thereof.

The developing unit forms an image on the image transfer body according to the printing content transferred from a computer, and includes a laser scan unit 20, a developing device 19, an OPC drum 15, and a developing unit transfer roller 17.

The laser scan unit 20 is installed above the OPC drum 15 and scans a laser beam corresponding to the printing content according to a command from an image forming apparatus controller (not shown) on the OPC drum 15.

The OPC drum 15 has a surface on which an electrostatic latent image is formed according to the laser beam and is installed above the developing unit transfer roller 17. The electrostatic latent image is developed as a visible image by the developing agent supplied by the developing device 19 as the OPC drum 15 rotates, and the developed visible image is transferred to the image transfer body by the developing unit transfer roller 17. The developing device 19 has the developing agent and develops an electrostatic latent image to a visible image by supplying the developing agent to the OPC drum 15.

The fixing unit fixes an image, transferred by the developing unit to the image transfer body, on the image transfer body using heat and pressure, and has a fixing roller 21 and a pressure roller 23.

A delivery unit discharges the image transfer body from the fixing unit when printing is completed and has a first delivery roller 25, a second delivery roller 27, a third delivery roller 31 and a delivery convey guide 33.

In the case of duplex printing, a duplex printing unit returns a one-side printed image transfer body to the transfer roller 5. Then the image transfer body returned to the transfer roller 5 passes the developing unit and the fixing unit to print on the other side. The duplex printing unit has a first duplex roller 35, a first duplex convey guide 37, a second duplex convey guide 39, and a second duplex roller 41 to return the image transfer body. The first duplex roller 35 is installed in contact with the second delivery roller 27, with an idle roller 29 therebetween.

A drive mechanism driving each structural unit of the electrophotographic image forming apparatus as described above will now be explained. The drive mechanism is installed at one side of each structural unit.

Referring to FIG. 2, a conventional drive mechanism of the electrophotographic image forming apparatus capable of duplex printing of FIG. 1 has a first driving part and a second driving part.

The first driving part drives all described structural units except the third delivery roller 31 and has a first driving motor 50, a first gear train 51, and a second gear train 71.

The first gear train 51 transmits the power of the first driving motor 50 to the pickup roller 3, the transfer roller 5, and the registration roller 7 and has an intermediate gear train 55 and a pickup roller gear train 59. If the manual paper feeding tray 13 is attached, the first gear train 51 additionally has a multipurpose pickup roller gear train 69 for driving the manual paper feeding tray 13.

A gear 52 at one end of the intermediate gear train 55 is engaged with a pinion 50' of the first driving motor 50. An intervening gear 54 at the other end of the intermediate gear train 55 is engaged with a registration gear 63 coaxially connected with the registration roller 7 and a transfer roller gear train 61 coaxially connected with the transfer roller 5. A gear 56 at one end of the pickup roller gear train 59 is engaged with the intermediate gear train 55 and the other end includes a pickup roller gear 58 coaxially connected with the pickup roller 3. One end of the multipurpose pickup roller gear train 69 is a reverse roller gear 65 engaged with the transfer roller gear train 61 and the other end includes a multipurpose pickup roller gear 67 coaxially connected with the multipurpose pickup roller 11. The reverse roller gear 65 is coaxially connected with a reverse roller 9 conveying the image transfer body together with the feeding unit transfer roller 5.

The second gear train 71 transmits the power of the first driving motor 50 to the OPC drum 15, the fixing roller 21, the first delivery roller 25, the first duplex roller gear 35, and the second duplex roller 41, and has an OPC drum gear train 75, a fixing roller gear train and a second duplex roller gear train 93 having gears 91 and 92.

The OPC drum gear train 75 has a transmission gear 72 at one end, which is engaged with the pinion 50' of the first driving motor 50, and an OPC drum gear 74 at the other end, which is coaxially connected with the OPC drum 15. The fixing roller gear train includes sub-fixing roller gear train 80, a first delivery roller gear train 85 and a first duplex roller gear train 89. The sub-fixing roller gear train 80 has a gear 77 at one end, which is engaged with the transmission gear 72 of the OPC drum gear train 75, and a gear at the other end, which includes a fixing roller gear 79 coaxially connected with the fixing roller 21. A gear 82 at one end of the first fixing roller gear train 85 is engaged with the fixing roller gear 79, and the other end includes a first delivery roller gear 84, coaxially connected with the first delivery roller 25. A gear 86 at one end of the first duplex roller gear train 89 is engaged with a gear of the first delivery roller gear train 85, and the other end includes a first duplex roller gear 88 coaxially connected with the first duplex roller 35.

The second driving part is for driving the third delivery roller 31 and includes a second driving motor 95 and a third delivery roller gear train 99.

A gear 96 at one end of the third delivery roller gear train 99 is engaged with a pinion 95' of the second driving motor 95 and a gear at the other end includes a third delivery roller gear 98 coaxially connected with the third delivery roller 31.

Hereinbelow, the operation of the conventional drive mechanism will be described.

When a printing order is received from the computer, the controller of the image forming apparatus drives the first driving motor 50 and the second driving motor 95.

If the first driving motor 50 rotates, the gear 52 at one end of the intermediate gear train 55 engaged with the pinion 50' of the first driving motor 50 is rotated and the intervening gear 54 at the other end is rotated by a connecting mediate gear.

If the intervening gear 54 rotates, a gear 56 at one end of the pickup roller gear train 59 engaged with the intervening gear 54, transfer roller gear 61 and the registration roller gear 63 rotates. If the gear 56 at one end of the pickup roller gear train 59 rotates, the pickup roller gear 58 rotates accordingly. If the pickup roller gear 58 rotates, the pickup roller 3 coaxially connected with the pickup roller gear 58 rotates and the image transfer body stacked on the paper feeding cassette 1 is separated and conveyed to the feeding unit transfer roller 5. As the transfer roller gear train 61 and the registration roller gear 63 rotate in association with the rotation of the intervening gear 54, the feeding unit transfer roller 5 and the registration roller 7 coaxially connected with these gears rotate. Therefore, the image transfer body conveyed from the pickup roller 3 is supplied to the developing unit passing the feeding unit transfer roller 5 and the registration roller 7.

Meanwhile, if the paper feeding unit has the manual paper feeding tray 13, the multipurpose pickup roller gear train 69 is engaged with the transfer roller gear 61. Accordingly, the rotation of the first driving motor 50 rotates the multipurpose pickup roller gear train 67 through the reverse roller gear 65 engaged with the transfer roller gear train 61. If the multipurpose pickup roller gear 67 rotates, the multipurpose pickup roller 11 coaxially connected thereto rotates, and therefore the image transfer body stacked on the manual paper feeding tray 13 is separately supplied to the registration roller 7. The controller of the image forming apparatus selects which image transfer body to supply using a sensor (not shown) when the image transfer body is stacked on both the paper feeding cassette 1 and the manual paper feeding tray 13.

In addition, if the first driving motor 50 rotates, the transmission gear 72 of the OPC drum gear train 75 engaged with the pinion 50' of the first driving motor 50 rotates. If the transmission gear 72 rotates, the OPC drum gear 74, which is the other end gear of the OPC drum gear train 75, rotates by the associated gear train. If the OPC drum gear 74 rotates, the OPC drum 15 coaxially connected to the OPC drum gear 74 rotates. If the OPC drum 15 rotates, an electrostatic latent image generated on the surface of the OPC drum 15 is developed as a visible image by a developing device and transferred to the image transfer body between the OPC drum 15 and the developing unit transfer roller 17 by the registration roller 7.

Additionally, if the transmission gear 72 rotates, the sub-fixing roller gear train 80 engaged with the transfer gear 72 also transmits the rotation. Accordingly, the other end gear of the sub-fixing roller gear train 80 (the fixing roller gear 79) rotates and the fixing roller 21 coaxially connected to the fixing roller gear 79 also rotates. If the fixing roller 21 rotates, the image transfer body which has passed the OPC drum 15 passes between the fixing roller 21 and the pressure roller 23 installed below the fixing roller 21. At this point, the image transferred to the image transfer body is fixed by heat and pressure.

Furthermore, if the fixing roller gear 79 rotates, the first delivery roller gear train 85 engaged with the fixing roller gear 79 rotates and also the first duplex roller gear train 89 engaged with a gear of the first delivery roller gear train 85 rotates. Then, the first delivery roller gear 84 installed at the other end of the first delivery roller gear train 85 and the first duplex roller gear 88 installed at the other end of the first duplex roller gear train 89 also rotate. If the first duplex roller gear 88 rotates, the second delivery roller gear (not shown) also rotates by the idle gear (not shown). Therefore, since the first delivery roller 25 and the second delivery roller 27 each coaxially connected with the first delivery roller gear 84 and the second delivery roller gear also rotate, the image transfer body which has passed the fixing roller 21 is conveyed to the third delivery roller 31 along the delivery convey guide 33 by the driving force of the first and second delivery rollers 25, 27.

The third delivery roller 31 rotates by the third delivery roller gear train 99 engaged with the second driving motor 95. The second driving motor 95 is driven simultaneously with the first driving motor 50 or may be driven by the controller of the image forming apparatus before the image transfer body enters the third delivery roller 31.

Hence, if the second driving motor 95 rotates, a gear at one end of the third delivery roller gear train 99 engaged with the pinion 95' of the second driving motor 95 rotates and the third delivery roller gear 98 at the other end rotates by the associated gear train. Then the third delivery roller 31 coaxially connected with the third delivery roller gear 98 rotates and consequently the image transfer body conveyed from the second delivery roller 27 is discharged to the outside.

In the case of duplex printing, before the end of the image transfer body passes the third delivery roller 31, the third delivery roller 31 rotates in reverse and has the front page printed image transfer body enter the duplex printing unit. The third delivery roller 31 is rotated in reverse by the reverse rotation of the second driving motor 95 when the end of the image transfer body passes the third delivery roller 31, exits the delivery convey guide 33 and rotates upward by its own rigidity, thereby being able to enter the duplex printing unit.

In the duplex printing unit, the image transfer body enters the first duplex convey guide 37 via the first duplex roller 35, rotating due to the first driving motor 50. After passing the first duplex convey guide 37, the image transfer body is conveyed to the feeding unit transfer roller 5 by the second duplex convey guide 39 and the second duplex roller 41. The second duplex roller 41 also rotates in the direction to which the image transfer body is conveyed to the feeding unit transfer roller 5 by the first driving motor 50. The front page printed image transfer body conveyed to the feeding unit transfer roller 5 is delivered to the outside by the third delivery roller 31 with the other side being printed as it undergoes the same process described above.

Therefore, the drive mechanism of the conventional electrophotographic image forming apparatus is able to print the front side of the image transfer body by unidirectionally rotating the first driving motor 50 and the second driving motor 95. Also, in the case of duplex printing, the back side can be printed by rotating the second driving motor 95 in reverse at a certain point and the front page printed image transfer body is then conveyed to the duplex printing unit.

However, since the conventional drive mechanism has the first driving motor 95 set to drive the pickup roller 3, the transfer roller, the multipurpose pickup roller, the registration roller 7, the OPC drum 15, the fixing roller 21, the first and second delivery rollers 25, 27, and the first and second duplex rollers 35, 39, the first driving motor 95 drives 90~95% of the total load of the image forming apparatus. Hence, the first driving motor 95 requires a large capacity and the manufacturing cost is high because large capacity motors are expensive.

In addition, because the fixing roller 21 continuously rotates from the point the image transfer body is supplied by the pickup roller 3, abrasion of the fixing roller 21 increases due to high heat and pressure, and image staining, such as offset, or electronic instability may occur due to the increase in static electricity.

SUMMARY OF THE INVENTION

Accordingly, it is an object of the present invention to overcome the above problems of the conventional drive mechanism.

It is another object of the present invention to provide a drive mechanism of an electrophotographic image forming apparatus that is inexpensive to produce by balancing the load of the first driving motor and the second driving motor, and using a low capacity and inexpensive motor for the first driving motor.

It is still another object of the present invention to provide an electrophotographic image forming apparatus having high efficiency during duplex printing by improving the transfer speed of the image transfer body during the duplex printing.

It is yet another object of the present invention to provide a drive mechanism of an electrophotographic image forming apparatus having improved lifespan of the fixing roller by rotating this element only when necessary.

Additional objects and advantages of the invention will be set forth in part in the description which follows and, in part, will be obvious from the description, or may be learned by practice of the invention.

The foregoing and other objects of the present invention are achieved by providing a drive mechanism of an electrophotographic image forming apparatus to form an image on an image transfer body, including a first driving part, including a conveyor to convey the image transfer body, an image forming apparatus to form the image on the image transfer body, a first driving motor to drive the conveyor and the image forming apparatus, and a first power transmitter to transmit power generated in the first driving motor to the conveyor and the image forming apparatus; and a second driving part, including a fixing device to fix the formed image on the image transfer body, a delivery roller to discharge the image transfer body having the image fixed thereon, a conveying roller to convey the image transfer body for duplex printing, a second driving motor to drive the fixing device, the delivery roller, and the conveying roller, and a second power transmitter to transmit power generated in the second driving motor to the fixing device, the delivery roller, and the conveying roller.

Furthermore, the second power transmitter may include a unidirectional power transmitting unit to prevent power of the second driving motor from being transmitted to the fixing device and the delivery roller when the second driving motor rotates in the direction in which the image transfer body is conveyed during duplex printing. The unidirectional power transmitter may be a ratchet gear.

Additionally, the second driving motor may have a rotation speed in a duplex printing direction set to be higher than a rotation speed in the opposite direction, and to be between 1.5 and 2 times higher than the rotation speed in the opposite direction.

The foregoing and other objects of the present invention may also be achieved by providing a drive mechanism of an electrophotographic image forming apparatus to form an image on an image transfer body, the drive mechanism including a first driving part, including a conveyor to convey the image transfer body, an image-forming device to form the image on the image transfer body, a first driving motor to drive the conveyor and the image forming apparatus, and rotating unidirectionally, and a first power transmitter to transmit power generated in the first driving motor to the conveyor and the image forming apparatus; and a second driving part, including a fixing device to fix the image on the image transfer body, a delivery roller to discharge the image transfer body having the image fixed thereon, a conveying roller to convey the image transfer body for duplex printing, a second driving motor to drive the fixing device, the delivery roller, and the conveying roller and rotating bidirectionally, and a second power transmitter to transmit power generated in the second driving motor to the fixing device, the delivery roller, and the conveying roller; wherein the second power transmitter includes a unidirectional power transmitting unit to prevent power of the second driving motor from being transmitted to the fixing device and the delivery roller when the second driving motor rotates in a duplex printing direction in which the image transfer body is transferred.

The unidirectional power transmitter may be a ratchet gear.

The second driving motor may have rotation speed in a duplex printing direction which is higher than a rotation speed in the opposite direction, and may be between 1.5 and 2 times higher than the rotation speed in the opposite direction.

The foregoing and other objects of the present invention may also be achieved by providing an electrophotographic image forming apparatus including a drive mechanism to form an image on a plurality of image transfer bodies, the drive mechanism including a first driving motor including a pinion; a paper feeding cassette; a pickup roller; a conveying roller; a registration roller; first and second duplex rollers; a fixing roller; first and third delivery rollers; an OPC (Organic Photo Conductor) drum; a first gear train, engaged with the pinion of the first driving motor to transmit power of the first driving motor to the pickup roller to thereby separate and convey the image transfer bodies stacked in the paper feeding cassette one by one to the conveying roller, which conveys the image transfer body conveyed by the pickup roller in a printing direction, and to the registration roller aligning and conveying the image transfer body conveyed from the conveying roller; a second gear train, engaged with the pinion of the first driving motor transmitting the power of the first driving motor to the OPC drum, transmitting an image to a front page of the image transfer body conveyed from the registration roller and to the second duplex roller conveying the front page transmitted image transfer body to the conveying roller; a second driving motor including a pinion; a third gear train, engaged with the pinion of the second driving motor, transmitting power of the second driving motor to the fixing roller fixing the transmitted image, and to the first delivery roller delivering the image transfer body conveyed from the fixing roller; and a fourth gear train, engaged with the pinion of the second driving motor, transmitting the power of the second driving motor to the third delivery roller, delivering the image transfer body conveyed from the first delivery roller to an outside.

The first gear train may include a registration gear coaxially connected with the registration roller; an intermediate gear train including a first mediate gear at a first end thereof engaged with the pinion of the first driving motor, and an intervening gear at a second end thereof and engaged with the registration gear; a transfer roller gear engaged with the intervening gear of the intermediate gear train and coaxially connected with the transfer roller; and a pickup roller gear train including a pickup roller gear having a gear at a first end thereof engaged with the intervening gear of the intermediate gear train and a second end coaxially connected with the pickup roller.

The second gear train may include an OPC drum gear train including an OPC gear having a second mediate gear at a first end thereof engaged with the pinion of the first driving motor and a second end coaxially connected with the OPC drum; and a second duplex roller gear train including a second duplex roller gear having a gear at a first end thereof engaged with the second mediate gear and a second end coaxially connected with the second duplex roller.

The third gear train may include a first delivery roller gear train including a first delivery roller gear having a third mediate gear at a first end thereof engaged with the pinion of the second driving motor and a second end coaxially connected with the first delivery roller; and a fixing roller gear train including a fixing roller gear having a gear at a first end thereof engaged with the third mediate gear of the first delivery roller gear train and a second end coaxially connected with the fixing roller.

The fourth gear train may include a third delivery roller gear train including a third delivery roller gear having a fourth mediate gear at a first end thereof engaged with the pinion of the second driving motor and a second end coaxially connected with the third delivery roller; and a first duplex roller gear train including a first duplex roller gear having a first end engaged with the fourth mediate gear and a second end coaxially connected with the first duplex roller.

A unidirectional power transmitting unit may be interposed between the pinion of the second driving motor and the third gear train to selectively transmit the unidirectional rotation of the second driving motor to the third gear train. The unidirectional power transmitting unit may be either a ratchet gear or a one-way clutch. Additionally, the unidirectional power transmitting unit may transmit power to the third gear train when the second driving motor rotates the fixing roller in the printing direction and does not transmit power when the second driving motor rotates in the opposite direction.

The drive mechanism of an electrophotographic image forming apparatus may have a multipurpose pickup roller gear train engaged with the transfer roller gear to drive a multipurpose pickup roller. One end of the multipurpose pickup roller gear train is a reverse rotation roller gear that is engaged with the transfer roller gear and coaxially connected to a reverse roller, and the other end is a multipurpose pickup roller gear coaxially connected to the multipurpose pickup roller gear.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
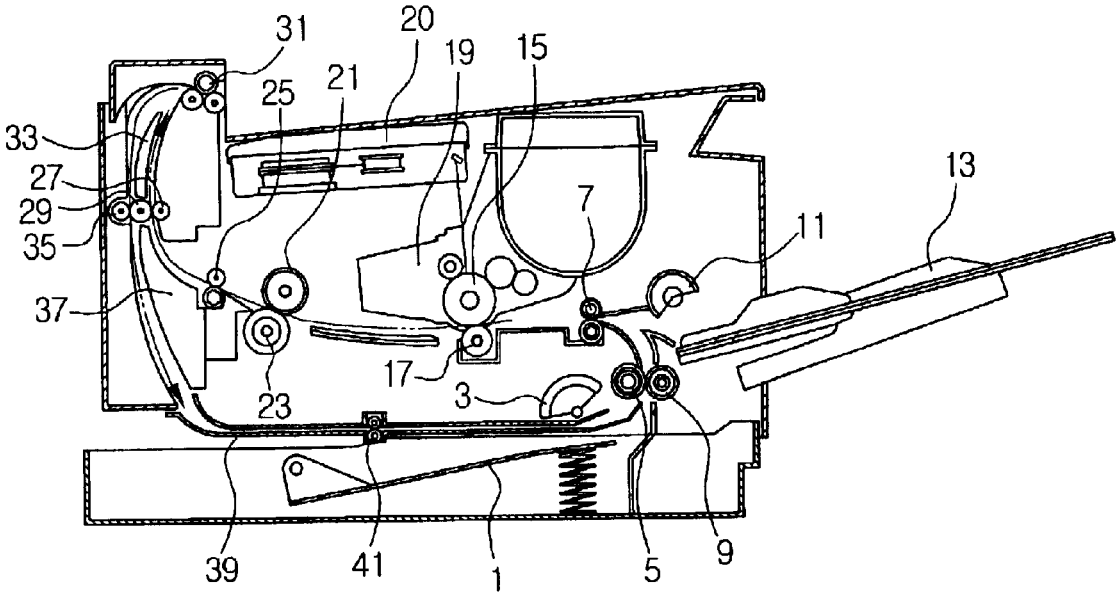
FIG. 1 is a schematic drawing showing an electrophotographic image forming apparatus having a duplex printing function.

Reference will now be made in detail to the present preferred embodiments of the present invention, examples of which are illustrated in the accompanying drawings, wherein like reference numerals refer to like elements throughout.

The drive mechanism of the electrophotographic image forming apparatus according to an embodiment of the present invention has a first driving part to convey an image transfer body and form an image thereon, and a second driving part to fix the image on the image transfer body and delivering it to the outside.

The first driving part has a conveyor to convey the image transfer body, an image forming apparatus to form a predetermined image on the image transfer body, a first motor to drive the conveyor and the image forming apparatus, and a first power transmitter to transmit power of the first driving motor to the conveyor and the image forming apparatus.

The conveyor includes a paper feeding cassette wherein the image transfer body is stacked, a pickup roller to separate the image transfer bodies stacked in the paper feeding cassette one by one and to convey the separated image transfer body, and a plurality of conveying rollers to convey the picked-up image transfer body to the image forming apparatus. In addition, the conveyor may also include a manual paper feeding cassette and a conveying roller manually supplying various types of image transfer bodies. The first driving motor may rotate only unidirectionally. The first power transmitter includes a number of gear trains or belts to transmit power of the first driving motor to the conveyor device and the image-forming device.

The second driving part includes a fixing device to fix the formed image on the image transfer body, a delivery roller to discharge the image transfer body having the image fixed thereon, a conveying roller to convey the image transfer body for duplex printing, a second driving motor to drive the fixing device, the delivery roller, and the conveying roller, and a second power transmitter to transmit power generated in the second driving motor to the fixing device, the delivery roller, and the conveying roller.

For duplex printing, the conveying roller for the duplex printing reverses the front page printed image transfer body to the image-forming device to print on the back side. The second driving motor may rotate bidirectionally, to allow for reverse rotation in the case of duplex printing. Additionally, the second power transmitter includes a unidirectional power transmitting unit to prevent the power of the second driving motor from being transmitted to the fixing device and the delivery roller when the second driving motor rotates, to allow the image transfer body to be conveyed in the duplex printing direction. The unidirectional power transmitting unit may be a ratchet gear.

In addition, the speed of the second driving motor is set to be higher when the image transfer body is conveyed in the duplex printing direction than when it is conveyed in the opposite direction, which is the normal printing direction. The speed of the second driving motor may be 1.5 or 2 times higher in the duplex printing direction than in the normal printing direction.

Figure 2:
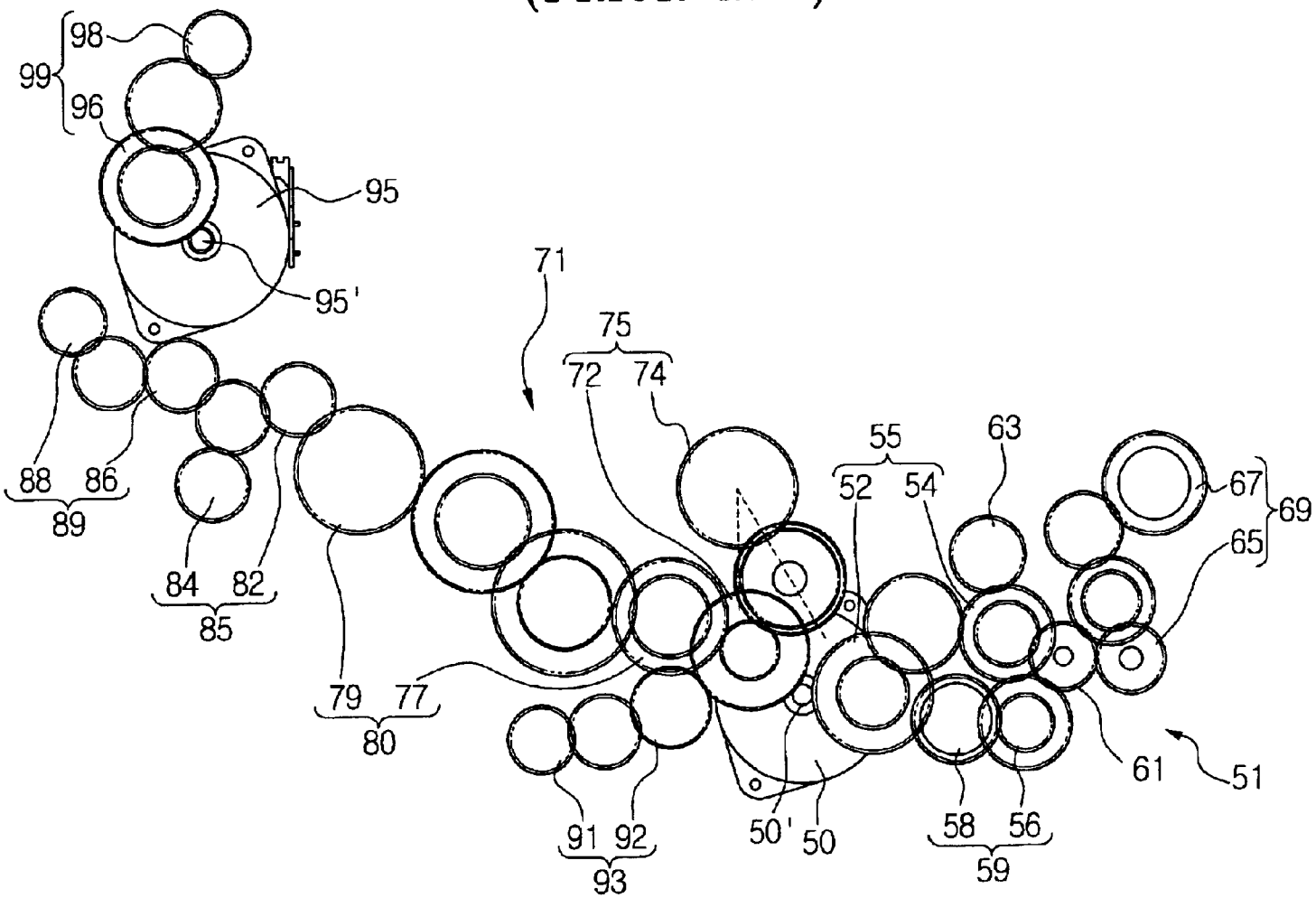
FIG.2 (PRIOR ART)
FIG. 2 is a schematic drawing showing a conventional drive mechanism to drive the electrophotographic image forming apparatus of FIG. 1.

Hereinafter, the embodiment of the drive mechanism of the electrophotographic image forming apparatus having a duplex printing function of the present invention will be described in detail with reference to the appended drawings. The present drive mechanism is described as being used in conjunction with the elements shown in FIG. 1. Furthermore, it is noted that parts which are the same as in the conventional drive mechanism are given the same numerals as in FIG. 2.

Figure 3:
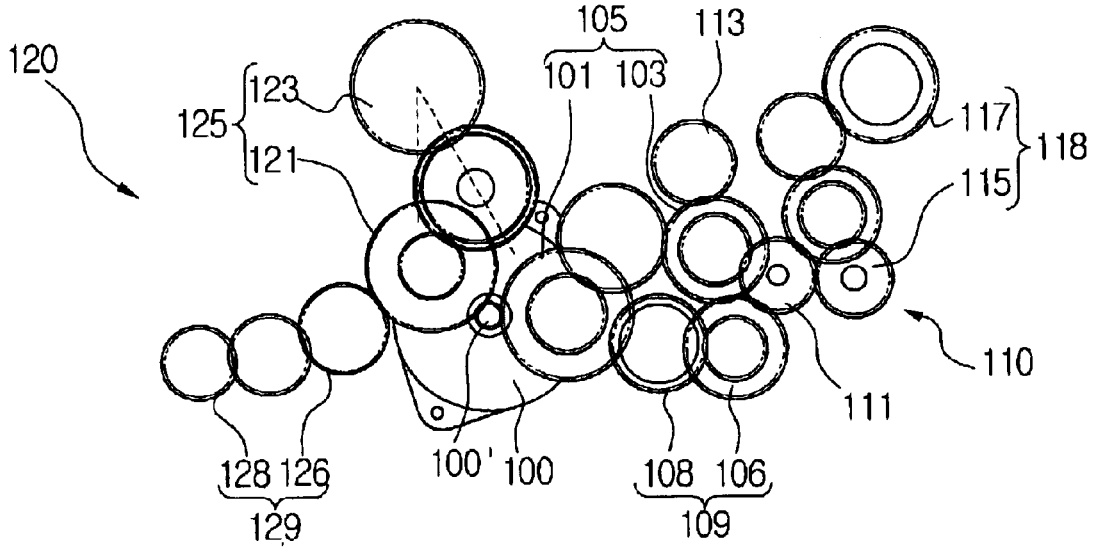
FIG. 3 is a schematic drawing showing the first driving part of the drive mechanism to drive the electrophotographic image forming apparatus of FIG. 1, according to an embodiment of the present invention.

Referring to FIG. 3, the image-forming device according to the embodiment of the present invention includes a first driving motor 100, a first gear train 110, and a second gear train 120.

The first driving motor 100 rotates the first gear train 110 and the second gear train 120 and a pinion 100' is engaged with a shaft of the motor 100. According to an aspect of the present invention, a unidirectionally rotatable motor is used for the first driving motor 100.

The first gear train 110 transmits power of the first driving motor 100 to the pickup roller 3, the developing unit transfer roller 17, and registration roller 7 and includes an intermediate gear train 105 and a pickup roller gear train 109. When the manual paper feeding tray 13 is attached, the first gear train 110 also includes a multipurpose pickup roller gear train 118 to drive the multipurpose pickup roller 11 of the manual paper feeding tray 13.

The intermediate gear train 105 has a first mediate gear 101 at one end thereof engaged with the pinion 100' of the first driving motor 100, and an intervening gear 103 at the other end, engaged with a registration roller gear 113 coaxially connected with the registration roller 7, and a transfer roller gear 111, which is coaxially connected with the developing unit transfer roller 17. Although a number of gear trains may be connected between the first mediate gear 101 and the intervening gear 103 according to the size and arrangement of the image-forming device, two mediate gear trains are illustrated herein.

The pickup roller gear train 109 has a gear 106 at one end engaged with the intervening gear 103 of the intermediate gear train 105 and a pickup roller gear 108 at the other end coaxially connected with the pickup roller 3. Although the pickup roller gear train 109 may also have a number of gear trains, only two gear trains are illustrated herein.

The multipurpose pickup roller gear train 118 has a reverse roller gear 115 at one end thereof, which is engaged with the transfer roller gear 111 and a multipurpose pickup roller gear 117 at the other end, which is coaxially connected with the multipurpose pickup roller 11. The reverse roller gear 115 is coaxially connected to the reverse roller 9 to convey the image transfer body together with the feeding unit transfer roller 5. The reverse roller gear 115 and the multipurpose pickup roller gear 117 may include a number of mediate gear trains but two mediate gear trains are illustrated herein.

The second gear train 120 transmits power of the first driving motor 100 to the OPC drum 15 (shown in FIG. 1), the fixing roller 21 (shown in FIG. 1), and the second duplex roller 41 (shown in FIG. 1) and includes an OPC drum gear train 125 and a second duplex roller gear train 129.

The OPC drum gear train 125 includes a second mediate gear 121 at one end thereof, which is engaged with the pinion 100' of the first driving motor and an OPC drum gear 123 at the other end, which is coaxially connected with the OPC drum 15. Although the OPC drum gear 123 and the second mediate gear 121 may be connected by a number of mediate gear trains depending on the size and arrangement of the image-forming device, one mediate gear is illustrated herein.

The second duplex roller gear train 129 includes a gear 126 at one end thereof, which is engaged with the second mediate gear 121 of the OPC drum gear train 125, and a second duplex roller gear 128 at the other end, which is coaxially connected with the second duplex roller 41. The gear 126 may be connected with a number of mediate gear trains according to the size and arrangement of the image forming apparatus, but only one mediate gear is illustrated herein.

Figure 4:
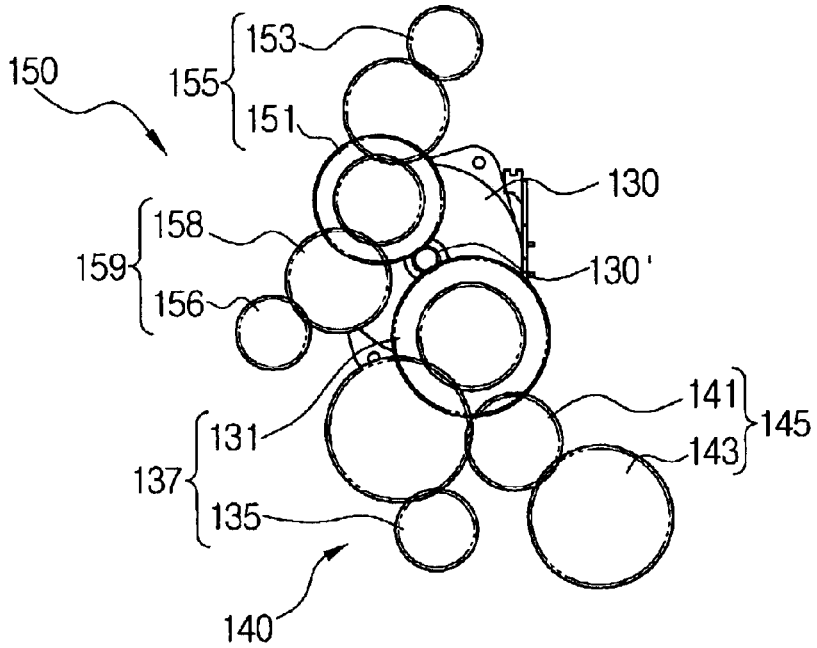
FIG. 4 is a schematic drawing showing the second driving part of the drive mechanism of of FIG. 3; and an electrophotographic image forming apparatus driven by the first driving part of FIG. 3 and the second driving part of FIG. 4.

Referring to FIG. 4, the second driving part includes a second driving motor 130, a third gear train 140 and a fourth gear train 150.

A second motor 130 rotates a third gear train 140 and the fourth gear train 150 and has a pinion 130' engaged with the end of the shaft of the second motor 130. A bidirectionally rotatable motor may be used for the second driving motor 130.

The third gear train 140 rotates the fixing roller 21 and the first delivery roller 25 using the second driving motor 130 and includes a fixing roller gear train 145 and a first delivery roller gear train 137.

The first delivery roller gear train 137 has a third mediate gear 131 at one end thereof that is engaged with the pinion 130' of the second driving motor 130 and a first delivery roller gear 135 at the other end, that is coaxially connected with the first delivery roller 25. The third mediate gear 131 and the first delivery roller gear 135 are connected by a number of mediate gear trains according to the size and arrangement of the image forming apparatus, but only one mediate gear is illustrated in the present embodiment.

The fixing roller gear train 145 has a gear 141 at one end that is engaged with the third mediate gear 131 and a fixing roller gear 143 at the other end that is coaxially connected with the fixing roller 21. The fixing roller gear train 145 may also be connected by a number of gear trains according to the size and arrangement of the image-forming device but only two mediate gear trains are illustrated herein.

Between the third gear train 140 and the pinion 130' of the second driving motor 130 is interposed a unidirectional power transmitter selectively transmitting the unidirectional rotation of the second driving motor 130.

A ratchet gear may be used for the third mediate gear 131 so that the unidirectional power transmitting unit transmits power to the fixing roller gear 143 and the first delivery roller gear 135 only when the second driving motor 130 rotates the fixing roller 21 and the first delivery roller 25 in the printing direction. In addition, the unidirectional power transmitting unit may also include a dual gear and a one-way clutch. In other words, using a dual gear for the third mediate gear 131, one gear is engaged with the pinion 130' of the second driving motor 130 and the other gear is at one end of the first delivery roller gear train 137 that is connected with the first delivery roller gear 135. The gear engaged with the pinion 130' of the second driving motor 130 is disposed on the third mediate gear shaft and a one-way clutch is disposed between this gear and the third mediate gear shaft. The one-way clutch is set to rotate the third mediate gear shaft only when the second driving motor 130 rotates in the printing direction. Therefore, when the second driving motor 130 rotates in the reverse direction, the first delivery roller gear 135 and the fixing roller gear 143 do not rotate since the third mediate gear shaft does not rotate, even though the pinion 130' of the second driving motor 130 rotates.

The fourth gear train 150 rotates the third delivery roller 31 and the first duplex roller 35 using power from the second driving motor 130, and includes a third delivery roller gear train 155 and a first duplex roller gear train 159.

The third delivery roller gear train 155 has a fourth mediate gear 151, one end of which is engaged with the pinion 130' of the second driving motor 130 and a third delivery roller gear 153 at the other end that is coaxially connected with the third delivery roller 31. The fourth mediate gear 151 and the third delivery roller gear 153 can be connected with a number of mediate gear trains depending on the size and arrangement of the image forming apparatus, but only one mediate gear is illustrated herein.

The first duplex gear train 159 has a gear 158 at one end thereof that is engaged with the fourth mediate gear 151 of the third delivery roller gear train 155 and a first duplex roller gear 156 at the other end that is coaxially connected with the first duplex roller 35. The first duplex roller gear train 159 may include a number of gear trains depending on the size and arrangement of the image-forming device, but two gear trains are illustrated herein to form the first duplex roller gear train 159.

Although gear size has not been described, a dual gear may be used according to the printing speed and the size of the image-forming device.

Hereinafter, operation of the drive mechanism of the electrophotographic image forming apparatus according to the present invention having the structure described above will be described referring to FIG. 3 through FIG. 4.

When the printing command is received from the computer, the controller (not shown) of the image forming apparatus drives the first driving motor 100. When the first driving motor 100 rotates, the first mediate gear 101 of the intermediate gear train 105 engaged with the pinion 100' of the first driving motor 100 rotates, and the intervening gear 103 rotates.

When the intervening gear 103 rotates, the gear 106 at one end of the pickup roller gear train 109 that is engaged with the intervening gear 103, the transfer roller gear 111, and the registration roller gear 113 rotate. When the pickup roller gear 108 rotates, the pickup roller 3 coaxially connected with the pickup roller gear 108 rotates, and accordingly, the image transfer bodies stacked in the paper feeding cassette 1 are separated one by one and conveyed to the feeding unit transfer roller 5. As the transfer roller gear 111 and the registration roller gear 113 rotate together according to the rotation of the intervening gear 103, the feeding unit transfer roller 5 and the registration roller 7 coaxially connected to the transfer roller gear train 111 and the registration roller gear train 113 also rotate. Therefore, the image transfer body conveyed from the pickup roller 3 is supplied to the developing unit, passing the feeding unit transfer roller 5 and the registration roller 7.

Meanwhile, if the manual paper feeding tray 13 is attached to the paper feeding unit, the multipurpose pickup roller gear train 118 is disposed to be engaged with the transfer roller gear 111 to supply the image transfer body. Accordingly, the rotation of the first driving motor 100 rotates the multipurpose pickup roller gear 117 at the other end of the multipurpose pickup roller gear train 118 through the reverse roller gear 115 engaged with the transfer roller gear 111. If the multipurpose pickup roller gear 117 rotates, the multipurpose pickup roller 11 coaxially connected to the multipurpose pickup roller gear 117 rotates, and therefore the image transfer body stacked in the manual paper feeding tray 13 is supplied separately to the registration roller 7. The controller of the image forming apparatus selects which image transfer body to supply when the image transfer body is stacked in both the paper feeding cassette 1 and the manual paper feeding tray 13, using a sensor.

Additionally, when the first driving motor 100 rotates, the second mediate gear 121 of the OPC drum gear train 125 engaged with the pinion 100' of the first driving motor 100 also rotates. When the second mediate gear 121 rotates, by the continuous gear train, the OPC drum gear 123 at the other end of the OPC drum gear train 125 rotates. When the OPC drum gear 123 rotates, the OPC drum 15 coaxially connected with the OPC drum gear 123 rotates. When the OPC drum 15 rotates, the electrostatic latent image formed on the surface of the OPC drum 15 by the laser beam of the laser scan unit 20 is developed into a visible image by the developing agent supplied from the developing device 19.

In addition, when the second mediate gear 121 rotates, the second duplex roller gear train 129 engaged with the second mediate gear 121 rotates. Accordingly, the second duplex roller 41 coaxially connected with the second duplex roller gear 128 also rotates. Meanwhile, the second duplex roller 41 rotates so that the image transfer body is conveyed from the reverse direction to the direction in which the image transfer body is conveyed by the OPC drum 15.

The controller of the image forming apparatus drives the second driving motor 130 in the printing direction at a predetermined point at which the image transfer body passes the OPC drum 15. When the second driving motor 130 rotates, the third mediate gear 131 of the first delivery roller gear train 137 engaged with the pinion 130' of the second driving motor 130 rotates. The ratchet gear of the third mediate gear 131, which is a unidirectional power transmitting unit, transmits the power as the second driving motor 130 rotates in the printing direction. Accordingly, the power is transmitted to the mediate gear of the first delivery roller gear train 137 and the first delivery roller gear 135 rotates. Therefore, the first delivery roller 25 coaxially connected with the first delivery roller gear 135 also rotates. Moreover, when the first delivery roller gear train 137 rotates, a gear 141 at one end of the fixing roller gear train 145 engaged with the mediate gear of the first delivery roller gear train 137 rotates, and therefore the fixing roller gear 143 also rotates. Then, the fixing roller 21 coaxially connected with the fixing roller gear 143 rotates, and accordingly, the image transfer body which has passed the OPC drum 15 passes between the fixing roller 21 and the pressure roller 23 disposed under the fixing roller 21. At this point, the image transferred on the image transfer body is fixed by the heat and power of the fixing unit.

The image transfer body, having had the image fixed thereon, is conveyed to the second delivery roller 27 passing the first delivery roller 25 by rotating the first delivery roller gear train 137.

Additionally, when the second driving motor 130 rotates, the fourth mediate gear 151 at one end of the third delivery roller gear train 155, engaged with the pinion 130' of the second driving motor 130 also rotates. When the fourth mediate gear 151 rotates, the third delivery roller gear 153 rotates through the rotation of the third delivery roller gear train 155. When the third delivery roller gear 153 rotates, the third delivery roller 31 that is coaxially connected to the third delivery roller gear 153 also rotates.

When the fourth mediate gear 151 rotates, the gear 158 at one end of the first duplex gear train 159 engaged with the fourth mediate gear 151 also rotates. Accordingly, the first duplex roller gear 156, which is the other end gear of the first duplex roller gear train 159, also rotates. When the first duplex roller gear train 159 rotates, the second delivery roller gear also rotates through the rotation of the idle gear. Then, the first duplex roller 35, the idle roller 29, and the second delivery roller 27 each coaxially connected with the first duplex roller gear 156, the idle gear, and the second delivery roller gear also rotate. Therefore, the image transfer body conveyed from the first delivery roller 25 passes the second delivery roller 27 and is conveyed to the third delivery roller 31 along the delivery convey guide 33.

The third delivery roller 31 is already rotating due to the second driving motor 130, and discharges the image transfer body conveyed from the second delivery roller 27 to the outside.

In the case of duplex printing, the front-page printed image transfer body is entered into the duplex printing unit as the third delivery roller 31 rotates in reverse before the end of the image transfer body is released out of the third delivery roller 31. The second driving motor 130 reverse rotates, and rotates the third delivery roller 31 in the reverse direction when the end of the image transfer body passing the third delivery roller 31 is released from the delivery convey guide 33, is flattened by its own stress, and is positioned to enter the duplex printing unit.

When the second driving motor 130 reverse rotates, the third delivery roller 31 rotates, and at the same time the first duplex roller 35 also rotates from the first duplex roller gear train 137 engaged with the third delivery roller gear train 155. Therefore, the front-page printed image transfer body which has entered the duplex printing unit by the third delivery roller 31 enters the second duplex convey guide 39, passing the first duplex convey guide 37 by the first duplex roller 35. The fixing roller 21 and the first delivery roller 25 do not rotate because the power transmission to the third gear train 140 engaged with the pinion 130' of the second driving motor 130 is blocked by the unidirectional power transmitting unit. Accordingly, when the second driving motor 130 reverse rotates, less work will be necessary than when rotating in the normal direction, which is the printing direction. Therefore, the speed of the reverse rotation of the second driving motor 130 can be 1.5 to 2 times higher than that of the normal rotation. As a result, the conveying speed of the image transfer body passing the duplex printing unit is faster, and the efficiency of the duplex printing is high.

In addition, when the front page printed image transfer body passes the first duplex roller 35, the second driving motor 130 stops and stands by or rotates in the normal direction and the printing process of the image transfer body entering the fixing roller 21 continues according to the status of the next image transfer body determined by the controller of the image forming apparatus.

The front-page printed image transfer body entering into the second duplex conveying guide 39 by the first duplex roller 35 is conveyed to the feeding unit transfer roller 5 by the second duplex roller 41. During this process, the second duplex roller 41 is rotating in the direction that the image transfer body is conveyed to the feeding unit transfer roller 5 by the first driving motor 100. The front page printed image transfer body that is conveyed to the feeding unit transfer roller 5 has the back page printed thereon and is discharged outside by the third delivery roller 31 by passing the same process as the front page printing process described above.

Therefore, the electrophotographic image forming apparatus according to the embodiment of the present invention can print both sides of the image transfer body using a motor having a smaller capacity than the conventional first driving motor 50.

Also, in the case of duplex printing, the conveying speed of the image transfer body and the efficiency of the duplex printing can be improved as the load of the second driving motor is reduced, thereby improving the speed of the motor rotation.

Moreover, abrasion of the fixing roller caused by heat can be reduced because the fixing roller rotates, not as the pickup roller rotates, but slightly before the transfer body enters the fixing roller at a predetermined point. Furthermore, due to the reduction of static electricity, the occurrence of image staining such as offset can be decreased.

As described above, the drive mechanism of the electrophotographic image forming apparatus according to the present invention can reduce production costs by using a small capacity motor because the load of the first driving motor can be reduced through balancing the load of the first and the second driving motors.

In addition, according to the drive mechanism of the embodiment of the present invention, during duplex printing, the convey speed of the image transfer body can be increased and therefore the efficiency of the duplex printing can be improved as the rotation speed can be increased by reducing the load of the second driving motor.

Furthermore, the drive mechanism of the electrophotographic image forming apparatus according to the present invention can improve the longevity of the fixing roller and printing quality because the fixing roller rotates only when necessary.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A drive mechanism of an electrophotographic image forming apparatus to form an image on an image transfer body, the drive mechanism comprising:

a first driving part, comprising:

an image forming apparatus to form the image on the image transfer body, a conveyor to convey the image transfer body to the image forming apparatus, a first driving motor to drive the conveyor and the image forming apparatus, and a first power transmitter to transmit power generated by the first driving motor to the conveyor and the image forming apparatus; and a second driving part, comprising:

a fixing device to fix the formed image on the image transfer body, a delivery roller to discharge the image transfer body having the image fixed thereon, a conveying roller to convey the discharged image transfer body for duplex printing, a second driving motor to drive the fixing device, the delivery roller, and the conveying roller, and a second power transmitter to transmit power generated by the second driving motor to the fixing device, the delivery roller, and the conveying roller.

2. The drive mechanism of claim 1, wherein the first driving motor rotates unidirectionally.

3. The drive mechanism of claim 1, wherein the second driving motor rotates bidirectionally.

4. The drive mechanism of claim 3, wherein the second power transmitter comprises a unidirectional power transmitting unit to prevent the power generated by the second driving motor from being transmitted to the fixing device and the delivery roller when the second driving motor rotates in a duplex printing direction in which the image transfer body is conveyed.

5. The drive mechanism of claim 4, wherein the unidirectional power transmitting unit comprises a ratchet gear.

6. The drive mechanism of claim 4, wherein the second driving motor has a rotation speed in the duplex printing direction higher than a rotation speed in a direction opposite to the duplex printing direction.

7. The drive mechanism of claim 6, wherein the rotation speed of the second driving motor in the duplex printing direction is between 1.5 and 2 times higher than the rotation speed in the opposite direction.

8. A drive mechanism of an electrophotographic image forming apparatus to form an image on an image transfer body, the drive mechanism comprising:

a first driving part, comprising:

an image forming device to form the image on the image transfer body, a conveyor to convey the image transfer body to the image forming device, image on the image transfer body;

a first driving motor to drive the conveyor and the image forming device, by rotating unidirectionally, and a first power transmitter to transmit power generated by the first driving motor to the conveyor and the image forming device; and a second driving part, comprising:

a fixing device to fix the image on the image transfer body, a delivery roller to discharge the image transfer body having the image fixed thereon, a conveying roller to convey the discharged image transfer body for duplex printing, a second driving motor to drive the fixing device, the delivery roller, and the conveying roller by rotating bidirectionally, and a second power transmitter to transmit power generated by the second driving motor to the fixing device, the delivery roller, and the conveying roller;

wherein the second power transmitter comprises a unidirectional power transmitting unit to prevent the power generated by the second driving motor from being transmitted to the fixing device and the delivery roller when the second driving motor rotates in a duplex printing direction in which the image transfer body is transferred.

9. The drive mechanism of claim 8, wherein the unidirectional power transmitting unit comprises a ratchet gear.

10. The drive mechanism of claim 8, wherein the second driving motor has a rotation speed in the duplex printing direction which is higher than a rotation speed in an opposite direction.

11. The drive mechanism of claim 10, wherein the rotation speed of the second driving motor in the duplex printing direction is between 1.5 and 2 times higher than the rotation speed in the opposite direction.

12. A drive mechanism of an electrophotographic image forming apparatus to form an image on a plurality of image transfer bodies, the electrophotographic image forming apparatus comprising a paper feeding cassette to stack the image transfer bodies therein, a pickup roller, a transfer roller, a registration roller, first and second duplex rollers, a fixing roller, first and third delivery rollers, and an OPC (Organic Photo Conductor) drum, the drive mechanism comprising:

a first driving motor including a pinion;

a first gear train, engaged with the pinion of the first driving motor to transmit power of the first driving motor to the pickup roller to thereby separate and pick up the image transfer bodies stacked in the paper feeding cassette one by one, to the transfer roller, the transfer roller conveying the picked-up image transfer body in a printing direction, and to the registration roller, the registration roller aligning and conveying the image transfer body conveyed from the transfer roller;

a second gear train, engaged with the pinion of the first driving motor to transmit the power of the first driving motor to the OPC drum, the OPC drum to transmit the image to a front page of the image transfer body conveyed by the registration roller, and to the second duplex roller, the second duplex roller to convey the front page transmitted image transfer body to the transfer roller;

a second driving motor including a pinion;

a third gear train, engaged with the pinion of the second driving motor, to transmit power of the second driving motor to the fixing roller, the fixing roller to fix the transmitted image onto the image transfer body, and to the first delivery roller, the first delivery roller to deliver the image transfer body from the fixing roller to the third delivery roller; and a fourth gear train, engaged with the pinion of the second driving motor, to transmit the power of the second driving motor to the third delivery roller, the third delivery roller to deliver the image transfer body received from the first delivery roller to an outside.

13. The drive mechanism of claim 12, wherein the first gear train comprises:

a registration gear coaxially connected with the registration roller;

an intermediate gear train comprising:

a first mediate gear at a first end thereof engaged with the pinion of the first driving motor, and an intervening gear at a second end thereof and engaged with the registration gear;

a transfer roller gear engaged with the intervening gear of the intermediate gear train and coaxially connected with the transfer roller; and a pickup roller gear train comprised of a pickup roller gear having a gear at a first end thereof engaged with the intervening gear of the intermediate gear train and a second end coaxially connected with the pickup roller.

14. The drive mechanism of claim 13, further comprising:

a manual paper feeding tray to store the image transfer bodies; and a multipurpose pickup roller;

a multipurpose pickup roller gear train engaged with the transfer roller gear to drive the multipurpose pickup roller to pick up the image transfer bodies from the manual paper feeding tray.

15. The drive mechanism of claim 14, further comprising a reverse roller, wherein the multipurpose pickup roller gear train comprises:

a reverse rotation roller gear at a first end thereof, engaged with the transfer roller gear and coaxially connected to the reverse roller, and a multi-purpose pickup roller gear at a second end thereof, coaxially connected to the multi-purpose pickup roller gear train.

16. The drive mechanism of claim 14, wherein a unidirectional power transmitting unit is interposed between the pinion of the second driving motor and the third gear train to selectively transmit unidirectional rotation of the second driving motor only to the third gear train.

17. The drive mechanism of claim 16, wherein the unidirectional power transmitting unit comprises a ratchet gear.

18. The drive mechanism of claim 12, wherein the second gear train comprises:

an OPC drum gear train comprising an OPC gear having a second mediate gear at a first end thereof engaged with the pinion of the first driving motor and a second end coaxially connected with the OPC drum; and a second duplex roller gear train comprising a second duplex roller gear having a gear at a first end thereof engaged with the second mediate gear and a second end coaxially connected with the second duplex roller.

19. The drive mechanism of claim 12, wherein the third gear train comprises:

a first delivery roller gear train comprised of a first delivery roller gear having a third mediate gear at a first end thereof engaged with the pinion of the second driving motor and a second end coaxially connected with the first delivery roller; and a fixing roller gear train comprised of a fixing roller gear having a gear at a first end thereof engaged with the third mediate gear of the first delivery roller gear train and a second end coaxially connected with the fixing roller.

20. The drive mechanism of claim 12, wherein the fourth gear train comprises:

a third delivery roller gear train comprised of a third delivery roller gear having a fourth mediate gear at a first end thereof engaged with the pinion of the second driving motor and a second end coaxially connected with the third delivery roller; and a first duplex roller gear train comprised of a first duplex roller gear having a first end engaged with the fourth mediate gear and a second end coaxially connected with the first duplex roller.

21. The drive mechanism of claim 12, further comprising a unidirectional power transmitting unit interposed between the pinion of the second driving motor and the third gear train to selectively transmit a unidirectional rotation of the second driving motor to the third gear train.

22. The drive mechanism of claim 21, wherein the unidirectional power transmitting unit comprises a ratchet gear.

23. The drive mechanism of claim 21, wherein the unidirectional power transmitting unit comprises a one-way clutch.

24. The drive mechanism of claim 21, wherein the unidirectional power transmitting unit transmits the power of the second driving motor to the third gear train when the second driving motor rotates the fixing roller in the printing direction and does not transmit the power of the second driving motor to the third gear train when the second driving motor rotates in a reverse direction opposite to the printing direction.

25. The drive mechanism of claim 24, wherein a rotation speed of the second driving motor in the reverse direction is higher than a rotation speed in the printing direction.

26. An electrophotographic image forming apparatus to form images on first and second sides of a transfer body, comprising:

a developer to form the images on the transfer body;

a first delivery roller to convey the image formed transfer body;

a third delivery roller to receive the image formed transfer body from the first delivery roller;

a first duplex roller to receive the transfer body from the third delivery roller and return the received transfer body to the developer;

a first drive unit to drive the developer; and a second drive unit to drive the first and third delivery rollers and the first duplex roller.

27. The apparatus of claim 26, further comprising:

a fixer roller to receive the image formed transfer body from the developer, wherein the fixer roller is driven by the second drive unit.

28. The apparatus of claim 27, further comprising:

a second duplex roller, to receive the transfer body from the first duplex roller and return the received transfer body to the developer, wherein the second duplex roller is driven by the first drive unit.

29. The apparatus of claim 28, wherein the third delivery roller conveys the received transfer body to an outside if the images are formed on the first and second sides of the received transfer body, and conveys the received transfer body to the first duplex roller if the images are formed only on the first side of the received transfer body.

30. The apparatus of claim 29, further comprising:

a second delivery roller to convey the image formed transfer body from the first delivery roller to the third delivery roller.

31. The apparatus of claim 30, further comprising:

a first gear train to transfer a power of the first drive unit to the developer;

a second gear train to transfer the power of the first drive unit to the second duplex roller;

a third gear train to transfer a power of the second drive unit to the first delivery roller and the fixer roller; and a fourth gear train to transfer the power of the second drive unit to the third delivery roller and the first duplex roller.

32. The apparatus of claim 26, further comprising:

a second duplex roller, to receive the transfer body from the first duplex roller and return the received transfer body to the developer, wherein the second duplex roller is driven by the first drive unit.

33. The apparatus of claim 26, wherein the third delivery roller conveys the received transfer body to an outside if the images are formed on the first and second sides of the received transfer body, and conveys the received transfer body to the first duplex roller if the images are formed only on the first side of the received transfer body.

* * * * *